US007350820B1

(12) United States Patent
Petkovsek

(10) Patent No.: US 7,350,820 B1
(45) Date of Patent: Apr. 1, 2008

(54) INTEGRAL SPECIAL SERVICE MAILING ASSEMBLY AND A METHOD FOR USING SAME

(75) Inventor: Glenn Petkovsek, Little Rock, AR (US)

(73) Assignee: United Systems of Arkansas, Little Rock, AR (US)

( * ) Notice: Subject to any disclaimer, the term of this patent is extended or adjusted under 35 U.S.C. 154(b) by 535 days.

(21) Appl. No.: 09/394,228

(22) Filed: Sep. 13, 1999

Related U.S. Application Data

(63) Continuation-in-part of application No. 08/855,030, filed on May 13, 1997, now Pat. No. 5,951,053, which is a continuation-in-part of application No. 08/425, 578, filed on Apr. 20, 1995, now Pat. No. 5,697,648.

(51) Int. Cl.
*B42D 15/00* (2006.01)

(52) U.S. Cl. ..... 283/61; 283/81; 283/116; 462/6; 462/7; 462/8; 462/64; 462/65; 281/2; 281/5; 229/74; 229/92; 229/92.1; 229/92.8; 229/300; 229/305; 428/40.1

(58) Field of Classification Search ..... 283/61, 283/81, 116; 462/6, 7, 8, 64, 65; 281/2, 281/5; 229/92, 92.8, 300, 74, 305, 92.1; 428/40.1
See application file for complete search history.

(56) References Cited

U.S. PATENT DOCUMENTS 4,418,865 A 12/1983 Bowen
4,492,334 A 1/1985 Dicker
4,565,317 A 1/1986 Kranz
4,682,793 A 7/1987 Walz
5,183,203 A 2/1993 Sanders
5,190,210 A 3/1993 Walz
5,348,780 A 9/1994 Boggs et al.
5,476,420 A 12/1995 Manning
5,507,526 A 4/1996 Petkovsek
5,524,934 A * 6/1996 Schwan et al. ..... 283/95
5,664,725 A * 9/1997 Walz ..... 229/92
5,697,648 A * 12/1997 Petkovsek ..... 283/61
5,752,647 A 5/1998 Schubert et al.
5,836,622 A * 11/1998 Fabel ..... 283/62
5,862,978 A 1/1999 Forrest
5,951,053 A 9/1999 Petkovsek

* cited by examiner

*Primary Examiner*—Monica Carter
*Assistant Examiner*—Mark Henderson
(74) *Attorney, Agent, or Firm*—Patents + TMS, P.C.

(57) ABSTRACT

An assembly for mailing an article requiring special services and a method for mailing same are provided. The assembly includes a return postcard, two anchor portions disposed on either side of the postcard, printer track strips having a plurality of holes for engaging a printer, such as a dot matrix printer, and a hole capable of being sensed by another type of printer, such as a thermal printer. The indicia printed upon the mailing assembly including the designator indicating the special service required, are printed using a single color thereby simplifying the printing process. The return postcard is removably attached to anchor portions such that the return postcard remains attached to the envelope until received by the addressee, at which time the return postcard may be removed from the anchor portions. The assembly is designed to incorporate a form into the return postcard to simplify preparation of the mailpiece for delivery by the special service.

17 Claims, 10 Drawing Sheets

INTEGRAL SPECIAL SERVICE MAILING ASSEMBLY AND A METHOD FOR USING SAME

This application is a continuation-in-part of U.S. patent application Ser. No. 08/855,030, filed May 13, 1997 which issued as U.S. Pat. No. 5,951,053 on Sep. 14, 1999 which is a continuation-in-part of U.S. patent application Ser. No. 08/425,578 filed Apr. 20, 1995 which issued as U.S. Pat. No. 5,697,648 on Dec. 16, 1997.

BACKGROUND OF THE INVENTION

The present invention generally relates to a form for mailing an article requiring special services. More specifically, the present invention relates to an integral special service mailing assembly for mailing an article requiring special services having a return receipt postcard and a label indicative of the special service and a method for using same.

It is, of course, generally known to mail an article requiring special services for delivery of the article, such as certified mail, registered mail, insured mail, COD, return receipt for merchandise and the like. Known components and methods for assembling a mailer for mailing an article requiring special services have multiple, separate components requiring attachment to an exterior of an envelope for the special services delivery of the article.

For example, when a customer of the U.S. Postal Service desires that an article be mailed by certified mail, for instance, an envelope containing the article is provided to the postal employee by the customer. The postal employee is then required to attach or otherwise provide the envelope with a permanent seal or label indicating that the envelope is to be delivered by certified mail.

Then, a return receipt postcard must be attached to the envelope. The postcard must be completed by the postal employee and/or the customer mailing the envelope containing the article. Some postcards include areas having an adhesive for attaching the postcard to the envelope. Other postcards require separate attachment, by using tape, for example.

Such a procedure is both complex and time-consuming, as well as labor intensive. The procedure requires the postal employee to ensure that all of the appropriate labels and documents are affixed to the envelope prior to delivery of the article. Therefore, the appropriate forms, labels and the like must be adequately stocked and available for the postal employee's use. Further, the postal employee must ensure that all articles are appropriately affixed to the envelope. In addition, the return receipt postcard must be suitably affixed to the envelope so that the return postcard is not removed during the mailing of the article to its destination. Of course, it should be understood that an envelope prepared for special service mailing may be prepared by any individual, not just a postal employee.

Further, preparation of a special services mailer requires printing of indicia on the mailer using a plurality of colors, such as black and the color associated with the special service. Therefore, the printing of the mailers is typically complex in that a mailer must be fed multiple times through a plurality of printers, one for each color, or a single printer with multiple color cartridges, ribbons or the like, so that multiple colors may be printed thereupon. This method of printing is both time-consuming and wasteful of resources and may require a printer having multiple color printing capabilities.

In addition, most mailers are not provided with tracking means so that the printing thereupon may be effected by a plurality of different printing mechanisms. For example, information may be printed using a dot matrix printer, or a thermal printer, or the like, that requires tracking holes located on the outer edges of the mailer. Further, thermal printing requires the use of a thermal printing hole located on the mailer to engage the thermal printer and to aid in the printing of the mailer by the printer.

A need, therefore, exists for an improved integral special service mailing assembly requiring special services, such as certified mail, insured mail, registered mail, COD, return receipt for merchandise and the like, and a method for using same.

SUMMARY OF THE INVENTION

The present invention provides an assembly and a method for using same for mailing an article requiring delivery by a special service, such as for certified mail, insured mail, register mail, COD, return receipt for merchandise and the like.

To this end, in an embodiment of the present invention a special service mailing assembly is provided. The assembly has a label having a front side and a backside wherein the label includes a return postcard and a designator section indicative of a special service wherein the designator is contained within exterior sides that define the return postcard and further wherein the label includes shading and printing wherein the shading and printing are a single color.

In an embodiment, a first anchor portion associated with the label is removably attached to the return postcard wherein the first anchor portion has an adhesive on a backside of the first anchor portion.

In an embodiment, a backing strip is disposed over the adhesive on the backside of the first anchor portion.

In an embodiment, a printer track strip is associated with the label extending outside one of the exterior sides of the return postcard wherein the printer track strip includes a hole.

In an embodiment, the assembly has a hole disposed therein.

In an embodiment, the label has a width defined between a first end and second end wherein the first end includes holes disposed therein.

In an embodiment, an area is provided within the designator section that has a machine readable code.

In an embodiment, a second anchor portion is attached to the return postcard wherein the second anchor portion has an adhesive on a backside of the anchor portion.

In another embodiment of the present invention, a method of preparing a mailpiece for delivery by a special service is provided. The method comprises the steps of: providing a label having a front side and a back side wherein the label includes a return postcard and a designator section indicative of a special service wherein the designator is contained within exterior sides that define the return postcard and further wherein the label includes a shading and printing wherein the shading and printing are a single color; providing at least one anchor portion on an exterior side of the return postcard wherein the anchor portion has a backside and further wherein the backside of the anchor portion includes an adhesive; removing a backing strip disposed over the adhesive; and attaching the adhesive label to a mailpiece to effect delivery by a special service.

In an embodiment, a hole is provided in the label.

In an embodiment, information is printed on the return postcard relating to delivery of the mailpiece by a special service.

In an embodiment, a printer tracking strip is provided that is removably attached to the anchor portion.

In another embodiment of the present invention, a special service mailing assembly is provided. The assembly has a plurality of labels removably attached continuously wherein each label has a front side and a back side and further wherein the label includes a return postcard and a designator section indicative of a special service wherein the designator is contained within the exterior sides that define the return postcard. Further, a printer tracking strip is associated with each label wherein the printer tracking strip includes a first hole and further wherein each label has a second hole.

In an embodiment, a first anchor portion is removably associated with each label removably attached to each return postcard wherein the first anchor portion has an adhesive on a backside of the first anchor portion.

In an embodiment, a strip is disposed over the adhesive on the backside of the first anchor portion.

In an embodiment, a second hole provided on each label is capable of being sensed by a printer.

In an embodiment, an area is provided within each designator section that has a machine readable code.

In an embodiment, a second anchor portion is associated with each label wherein the second anchor portion has an adhesive on a backside of the anchor portion.

In an embodiment, a tear line is disposed between each label to aid in the removal of each label from the assembly.

In an embodiment, a second hole is adjacent the tracking strip.

It is, therefore, an advantage of the present invention to provide an improved assembly for mailing an article requiring delivery by a special service.

Another advantage of the present invention is to provide a simplified method for mailing an article requiring special services.

And, another advantage of the present invention is to provide an assembly that is integrally formed as a complete unit for mailing and labeling of an article requiring special services.

Yet another advantage of the present invention is to provide an assembly and a method for mailing an article requiring special services without requiring additional adhesives or fixatives for attaching the same to the mailpiece.

Moreover, an advantage of the present invention is to provide an assembly and a method for mailing an article requiring special services that is substantially foolproof.

Yet, a further advantage of the present invention is to provide an assembly which works on automated printing equipment.

And, another advantage of the present invention is to provide an assembly including a label and a form that provides for pre-imaging or pre-printing of variable information thereon.

Moreover, an advantage of the present invention is to provide an assembly to aid in the delivery of a mailpiece by special service printed with only one color.

Another advantage of the present invention is to provide an assembly having printer track strips to aid in feeding the assembly through a printer.

Further, another advantage of the present invention is to provide an assembly having a plurality of labels continuously and removably attached.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an integral special service mailing assembly for mailing an article requiring special services. Further, the present invention provides a method for using the assembly for mailing articles requiring special services.

Figure 1:
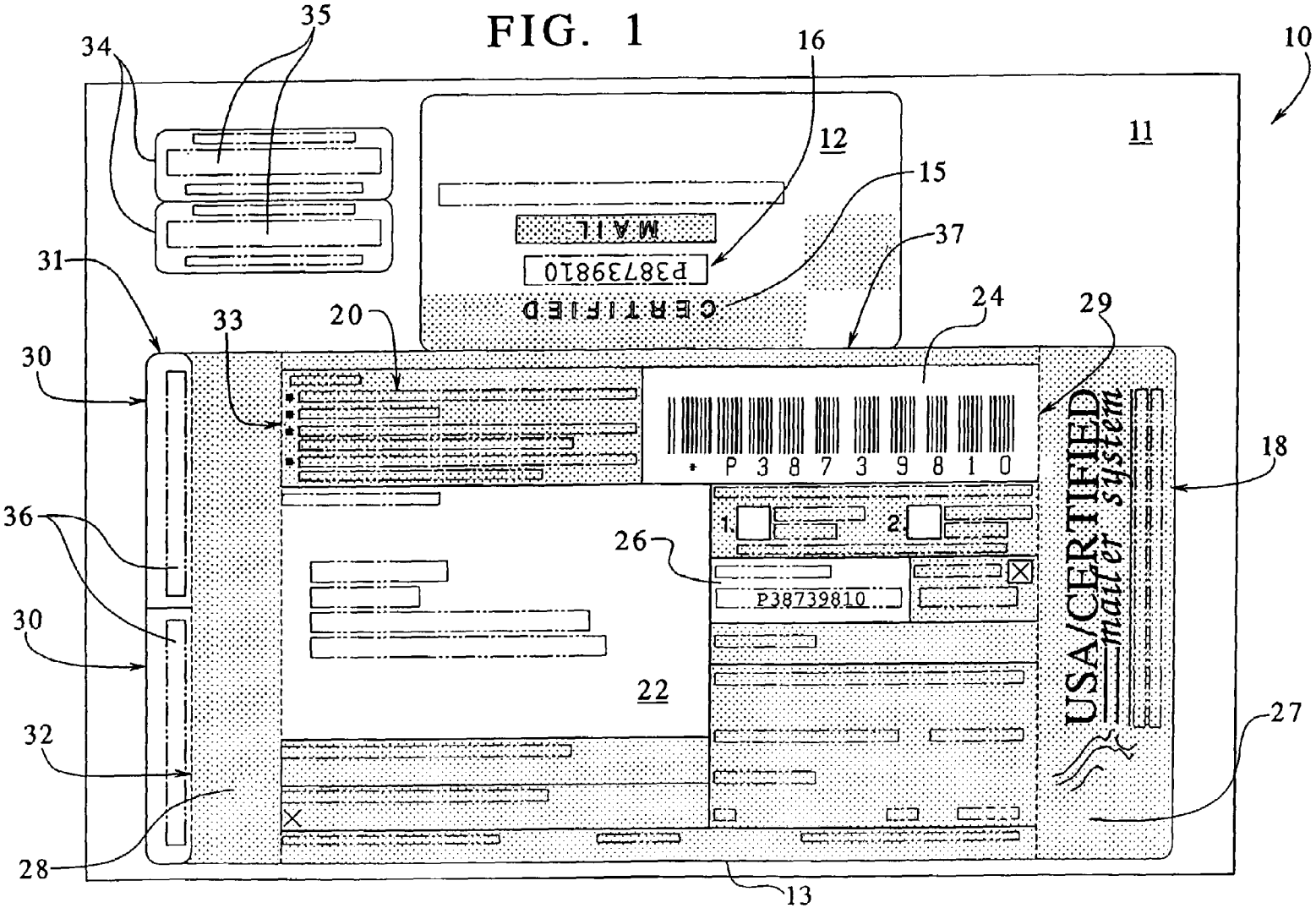
FIG. 1 illustrates a plan view of a front side of an embodiment of an assembly of the present invention.
Figure 4:
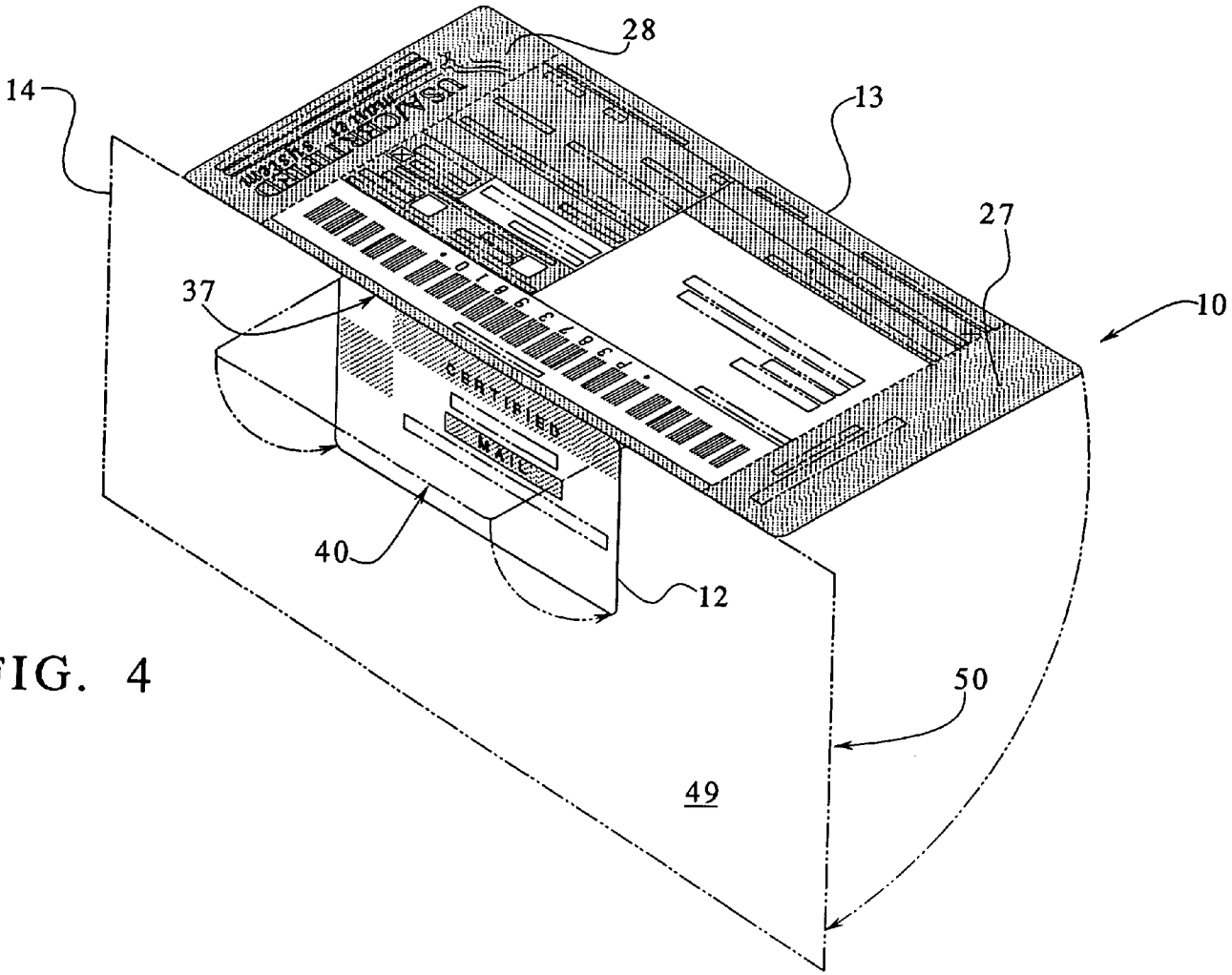
FIG. 4 illustrates a perspective view of a front side of an embodiment of the assembly of the present invention with an article to be mailed using same.

Referring now to the drawings, wherein like numerals refer to like parts, FIG. 1 is a front plan view that generally illustrates an embodiment of an assembly 10 formed from a single sheet 11 to provide both a label 12 and a return postcard 13. The assembly 10 is capable for use in mailing an article 14 requiring a special service as shown in FIG. 4. Although a certified mail envelope is illustrated, it should be understood that the present invention is applicable to any mailing item requiring special services, such as insured mail, registered mail, COD, return receipt for merchandise and the like.

The front side of the embodiment of the assembly 10 illustrated in FIG. 1 includes the label 12. The label 12 is, in a preferred embodiment, a pre-printed label indicative of the special service required for mailing of the article 14. The label 12 is preferably pre-printed directly on the sheet 11. The pre-printed label 12 includes a special service indicator 15 and a window section 16 in which an article identification number can be printed.

The assembly 10 also has a front bottom portion 18 that includes the return receipt postcard 13 that can be similar to United States Postal Service form PS-3811. The return receipt postcard 13 may include a set of instructions 20 for the sender, as well as an article addressee section 22 for pre-printing the addressee's address. The return receipt postcard 13 also has a document control number bar code 24 to aid in tracking of the article 14.

In addition, the return receipt postcard 13 has a number of sub-sections requiring completion by the sender prior to mailing. One sub-section illustrated at numeral 26 includes a machine readable article identification number corresponding to the number in the window section 16 of the pre-printed label 12. The sub-section 26 may have a background color that contrasts with the color of the return receipt postcard 13 so as to simplify the reading of the machine-readable code in the sub-section 26. Other sections, as well, may include similar color-contrasting portions within the return receipt postcard 13.

Another section of the bottom portion 18 of the assembly 10 is, in a preferred embodiment, a first anchor portion 27 at one end of the return receipt postcard 13 and a second anchor portion 28 at the opposite end. The first anchor portion 27 is separable from the return receipt postcard 13 by means of a perforated tear line 29.

The second anchor portion 28 includes at least one article tracking label 30 provided along a detachable strip 31 at the opposite end of the bottom portion 18 of the assembly 10 and is removable from the bottom portion 18 by a perforated tear line 32. The second anchor portion 28 is also separable from the return receipt postcard 13 by tearing along a perforated tear line 33.

The article tracking label 30 may be adhesively backed for subsequent attachment to a receipt or other item requiring designation of the article number for related purposes. As illustrated, two tracking labels 30 are provided in the embodiment shown. For example, one of the tracking labels 30 may be used by a postal delivery employee on a postal form PS 3849, a delivery notice, (not shown). The second tracking label 30 may be used for the receiver's record use.

In addition, in the embodiment shown, two additional tracking labels 34 are provided. The two additional tracking labels 34, which also include a section 35 for the article identification number, may be used for the sender's records.

The certified article number tracking labels 30 can also be used for the sender's and receiver's record keeping and/or accounting use. Each tracking label 30 has the section 33 for the article identification number. The tracking label 30 may be provided with adhesive on its reverse side. The tracking label 30 may also be a peel and stick type label.

Thus, the bottom portion 18 of the assembly 10 includes three main sections: the return receipt postcard 13 and the first and second anchor portions 27, 28. In addition, the tracking labels 30, 34 are provided. The label 12 is separated from the return receipt postcard 13 by a score line 37 to facilitate separation of the postcard 13 upon delivery of the article 14. As mentioned above, the return receipt postcard 13 has a number of sub-sections requiring completion by the sender prior to mailing the article 14. After delivery of the article 14, the return receipt postcard 13 is detachable from the first and second anchor portions 27, 28 by tearing along the perforated tear lines 29, 33 respectively.

An advantage of the present invention is that a number of the sub-sections of the return postcard 13 and the label 12 discussed above can be pre-printed when the assembly 10 of the present invention is used.

Figure 2:
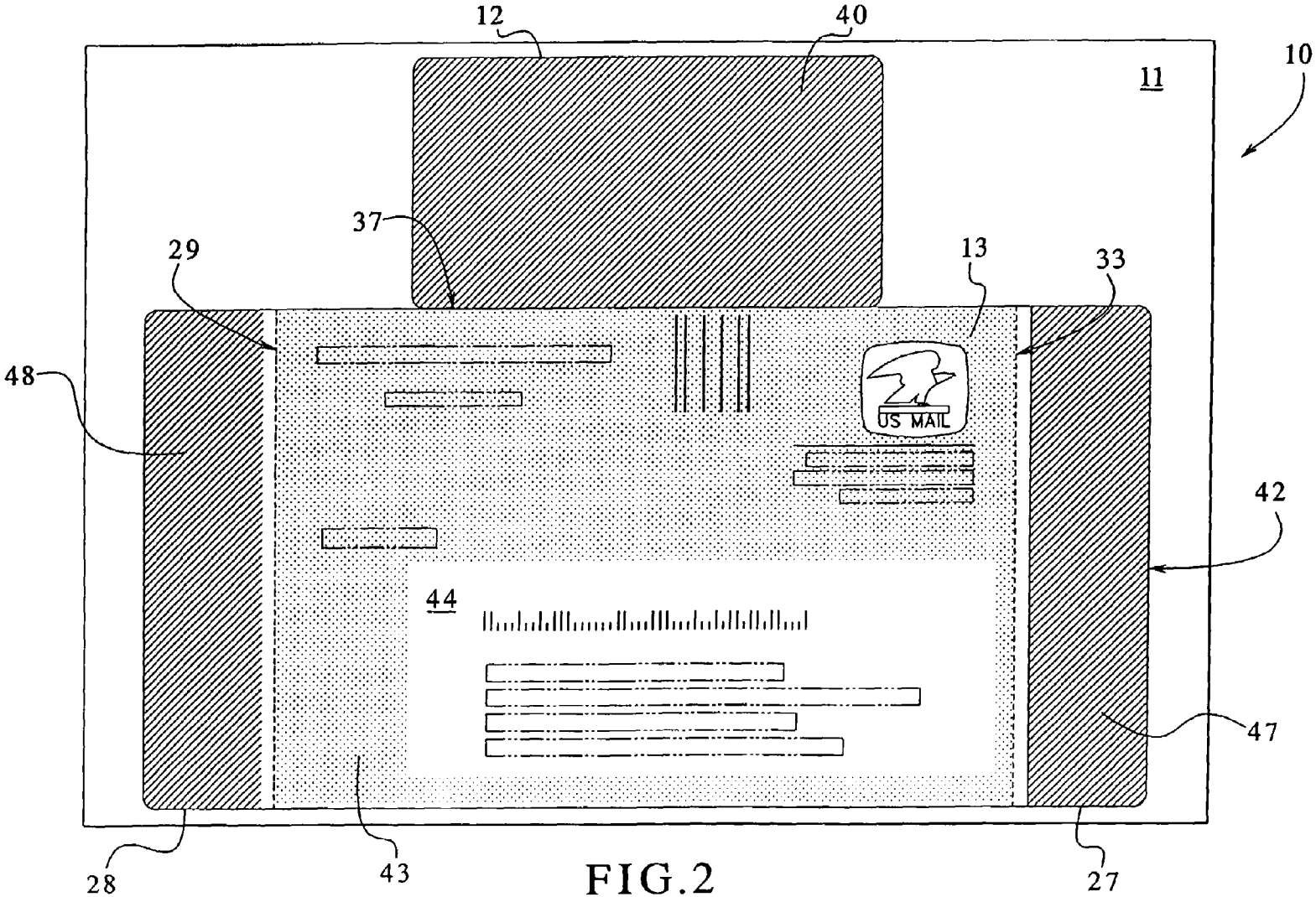
FIG. 2 illustrates a plan view of a back side of an embodiment of the assembly of the present invention.

Referring now to FIG. 2, a back plan view of an embodiment of the assembly 10 is illustrated. The reverse side of the label 12 shown in FIG. 1 has an adhesive portion 40. The adhesive portion 40 may be a peel and stick type adhesive and is provided to seal the label 12 to the article 14 requiring special service mailing as shown in FIG. 4.

A back bottom portion 42 of the assembly 10 includes a front side 43 of the return receipt postcard 13. The return receipt postcard 13 includes a "Return To" section 44. The "Return To" section 44 may be color-contrasted with the remainder of the return receipt postcard 13 to enable simplified reading of the "Return To" section 44.

The score line 37 is provided along the top side of the return receipt postcard 13. For subsequent detachment of the return receipt postcard 13, the perforated tear lines 29, 33 are provided along the edges adjacent to the anchor portions 27, 28. The first anchor portion 27 has a first adhesive portion 47 and the second anchor portion 28 has a second adhesive portion 48 to adhere the back bottom portion 42 to the article 14 prior to mailing.

Figure 3:
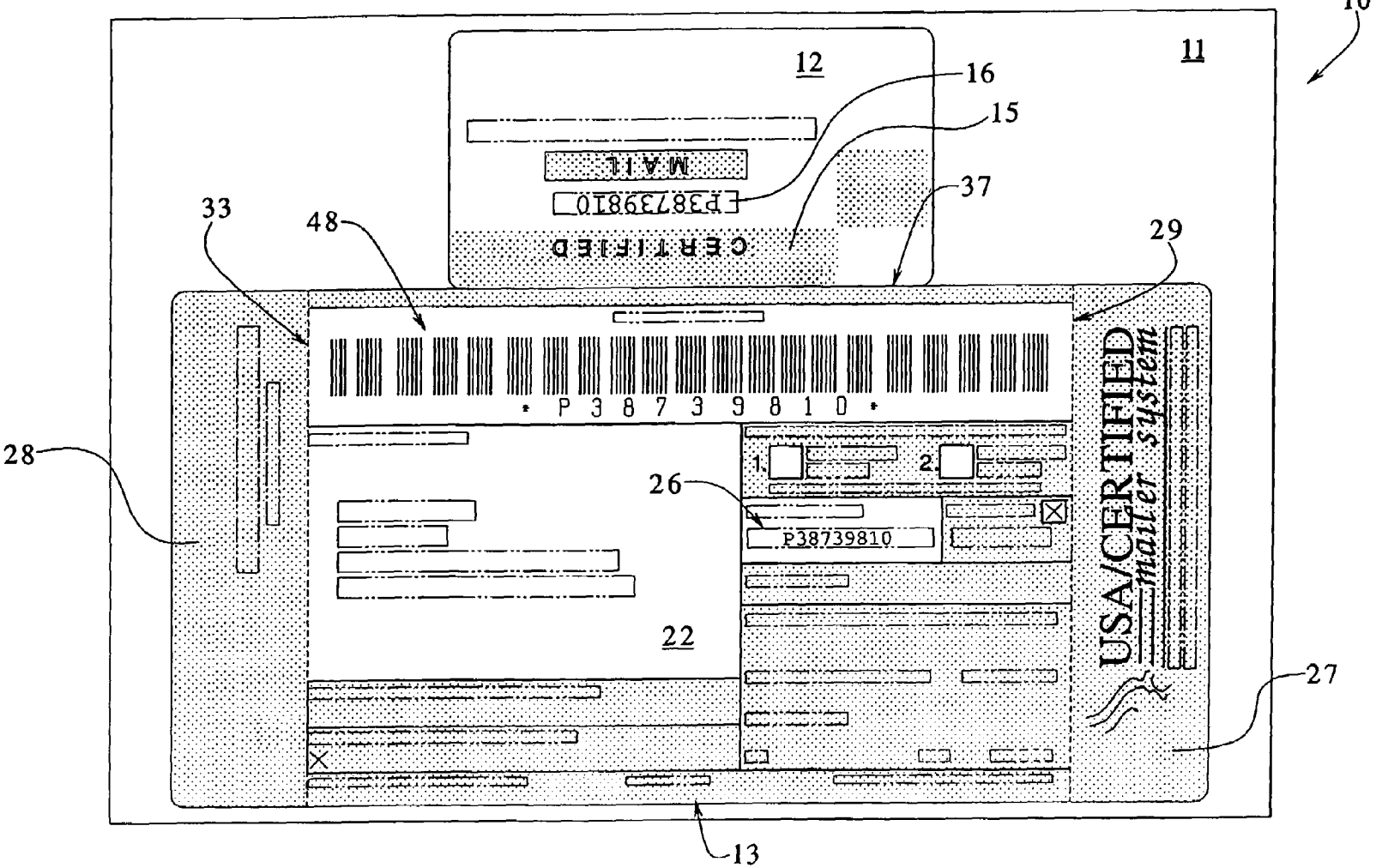
FIG. 3 illustrates a plan view of a front side of another embodiment of the assembly of the present invention.

FIG. 3 shows another embodiment of the assembly 10 of the present invention, wherein like numerals represent like parts. This embodiment is a simplified version of the prior embodiment in that it does not have the instruction section 20 nor does it have the tracking labels 30, 34. However, the embodiment illustrated in FIG. 3 as an enlarged bar code region 48 for easier reading during high speed processing. The embodiment of the present invention illustrated in FIG. 3 is shown in use in FIG. 4.

Referring now to FIG. 4, the article 14 requiring special service, shown from its front side, is shown. The pre-printed label 12 is shown having the window section 16 in which the certified mail number is printed either manually or automatically. As illustrated, the label 12 folds down onto a front side 49 of the article 14 requiring special service mailing. The label 12 is adhered to the front side 49 of the article 14 by means of the adhesive portion 40 located on the back side of the label 12 (see FIG. 2). Also as illustrated in FIG. 4, the bottom portion 18 of the assembly 10, including the anchor portions 27, 28 and the return receipt postcard 13, is sealed to a back side 50 of the article 14 and the anchor portions 27, 28 are sealed to the article 14 by the adhesive portions 47 and 48, respectively. Also, the score line 37 is located at the top of the article 14 to provide for easier subsequent separation of the return receipt postcard 13 from the anchor portions 27, 28 and the label 12 upon delivery of the article 14.

Figure 5:
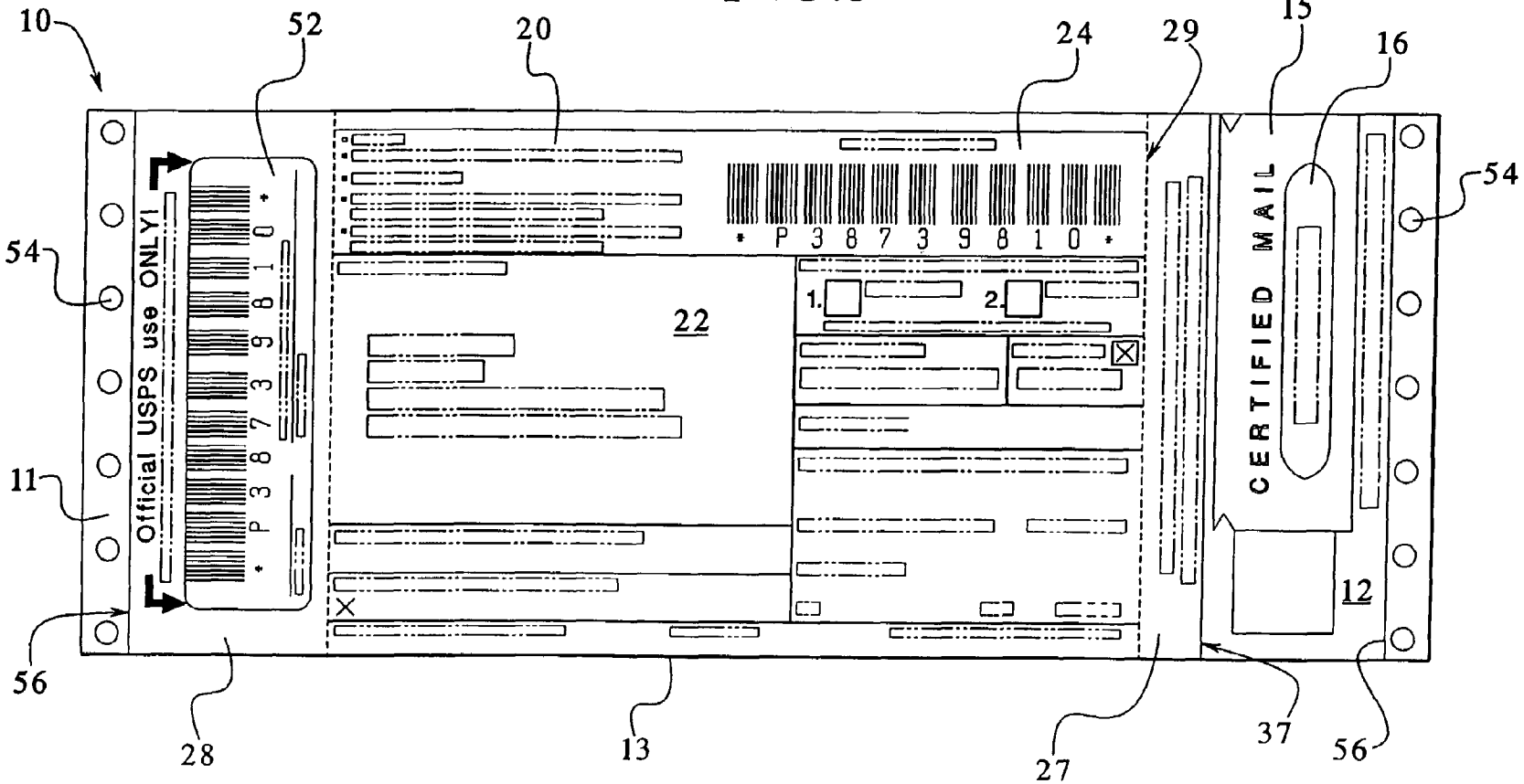
FIG. 5 illustrates a plane view of a front side of another embodiment of the assembly of the present invention.
Figure 6:
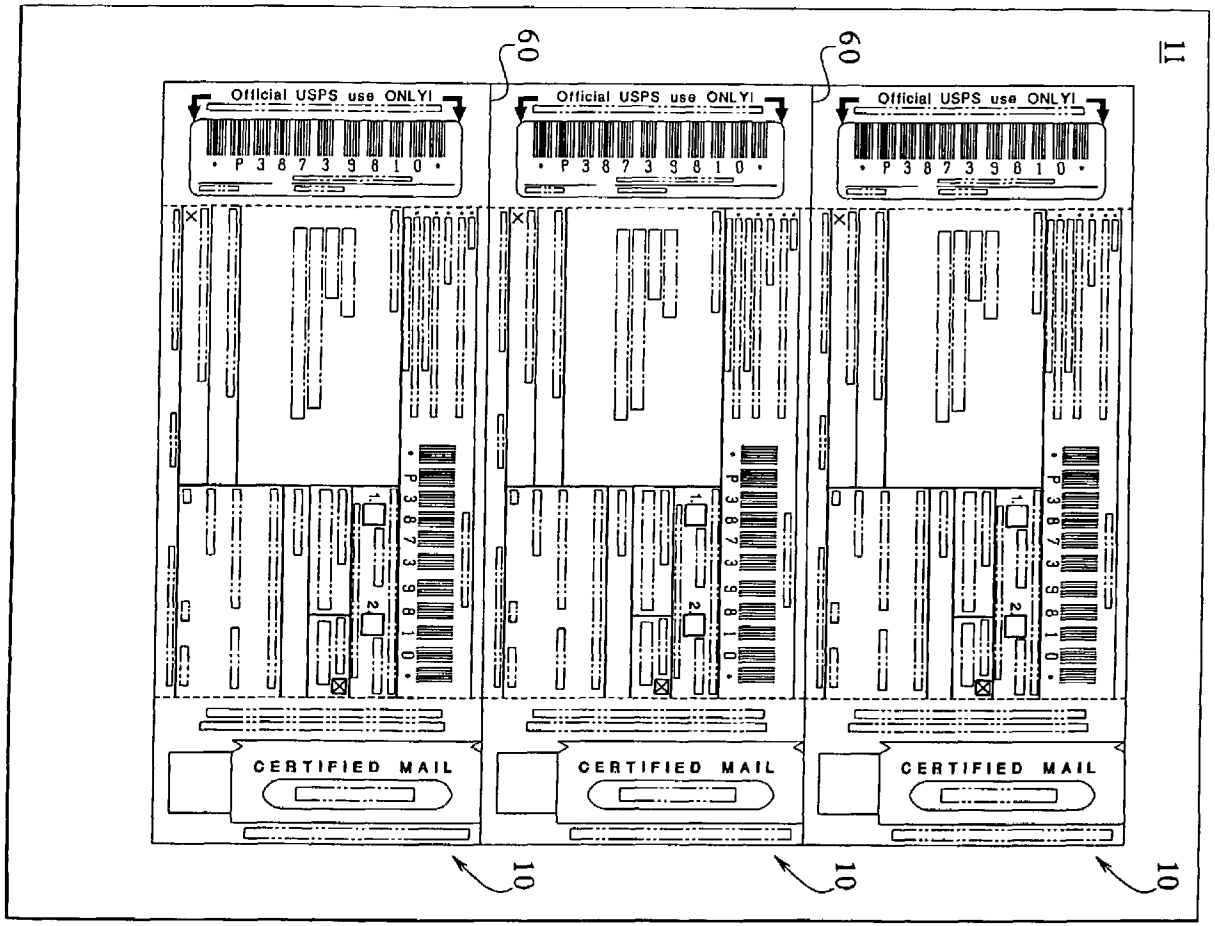
FIG. 6 illustrates another embodiment of the assembly of the present invention in which a plurality of assemblies are located on a single sheet.

FIG. 5 illustrates another embodiment of the assembly 10 of the present invention. In the embodiment shown in FIG. 5, the orientation of the label 12 with respect to the postcard 13 is changed. However, like numerals represent like parts and the score line 37 between the label 12 and the postcard 13 is shown located between the label 12 and the return receipt postcard 13. In addition, a tracking indicator 52 is provided on the second anchor portion 28. Another variation in the embodiment shown in FIG. 5 is that the sheet 11 has a plurality of tracker holes on the edges thereof for use in a printer having tracking wheels to advance the paper. The tracking holes 54 are located on a tracking strip 56. In addition, a plurality of the assembly 10 can be provided on a single sheet 11 as shown in FIG. 6. Each assembly 10 is separable from the adjacent assembly 10. This can be accomplished by a score line 60. In such a case, it would be preferred that the assembly 10 be a peel and stick type assembly that is removably attached to the sheet 11. Thus each individual assembly 10 could be detached from the sheet 11 as needed. Also the entire sheet could be printed at one time for subsequent separation and application to separate articles 14.

The assembly 10 can be printed using any known method of printing and is not limited to any single type. Such printing methods include, but are not limited to, laser printing, thermal printing, dot matrix printing and the like. Printing may be performed on continuously fed forms or on individually fed forms.

Figure 7:
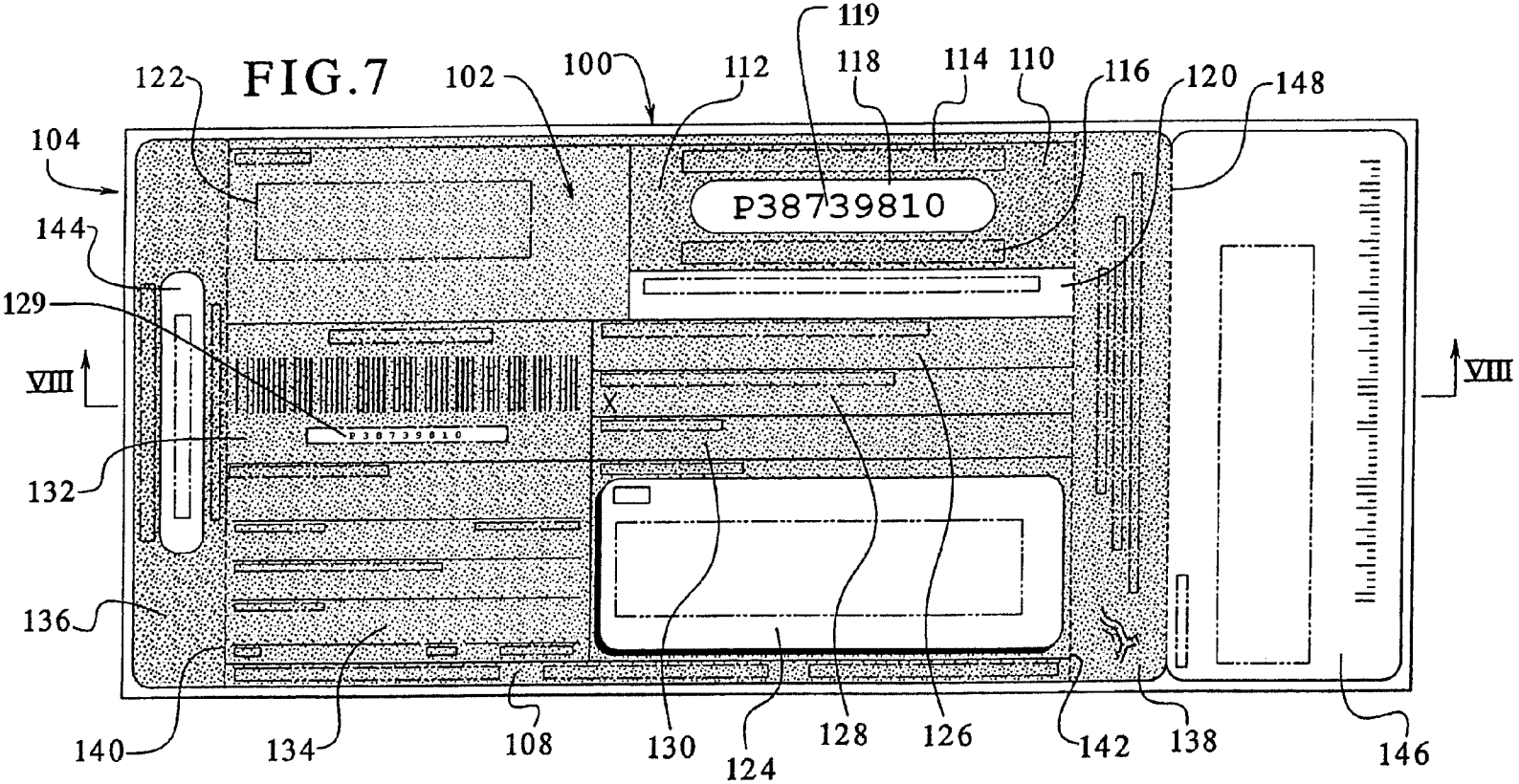
FIG. 7 illustrates a plan view of a front side of another embodiment of an assembly of the present invention.
Figure 8:
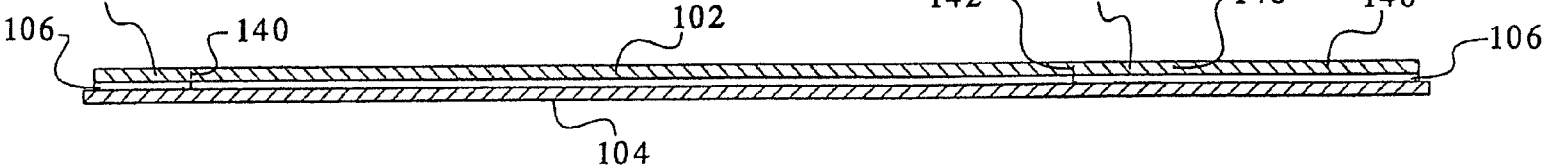
FIG. 8 illustrates a cross-sectional view taken generally along the line VIII-VIII of FIG. 7.
Figure 9:
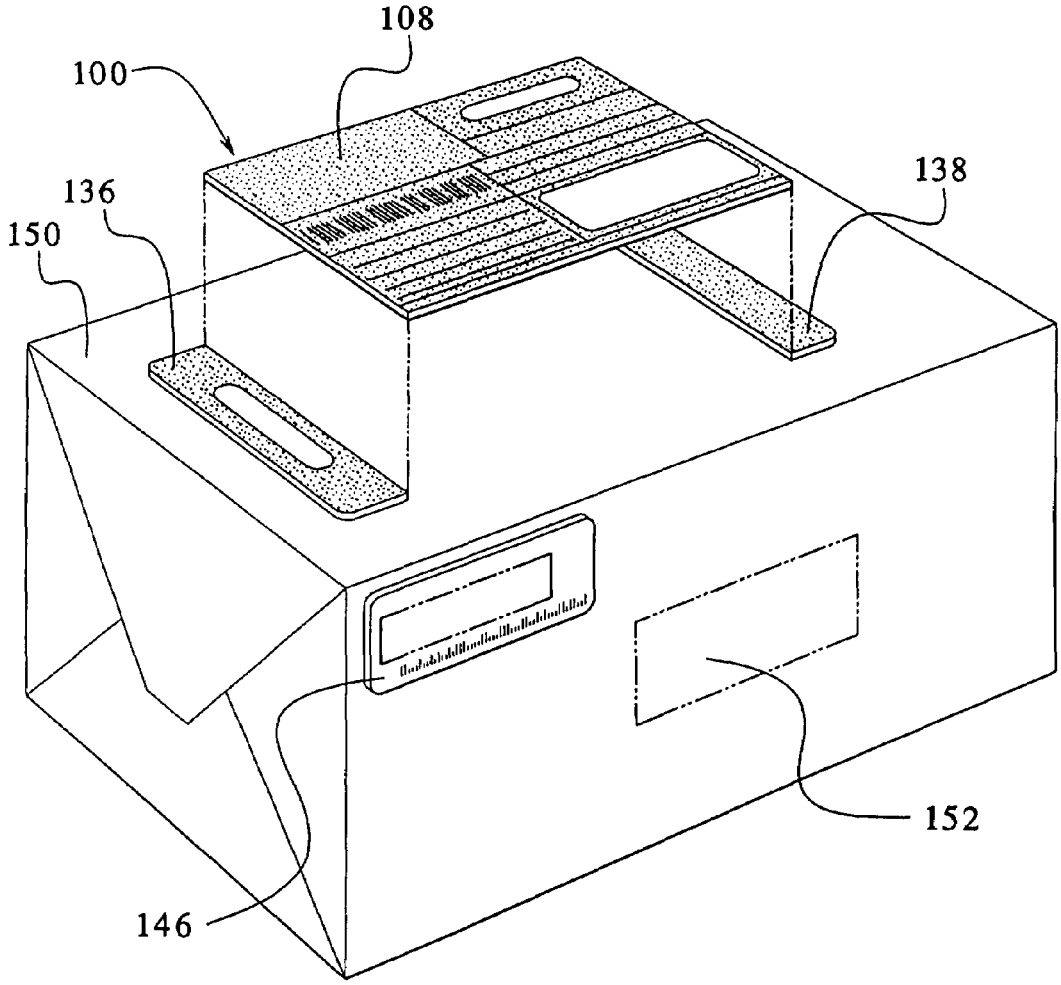
FIG. 9 illustrates a perspective view of an embodiment of the assembly as used on a package.

Referring now to FIGS. 7-9, an alternate embodiment of a mailing assembly 100 is illustrated. The mailing assembly 100 includes a first layer 102 and a second layer 104. The first layer 102 and the second layer 104 are separably attached via an adhesive 106 between selected portions of the two layers 102,104. The first layer 102 includes a plurality of separable parts including a return postcard 108 having an integrally formed designator section 110. The return postcard conforms with requirements for, for example, United States Postal Service Form 3811. The designator section 110 includes information necessary to comply with requirements for, for example, United States Postal Service Forms 3804, 3806, 3813, 3856 or the like. The designator section 110 heretofore has been implemented as a separate and distinct form apart from the return postcard 108. The unique arrangement of the return postcard 108 with the designator section 110 allows for incorporation of what previously required completion of two forms and subsequent attachment of two forms to, for example, a package to be delivered requiring special services for delivery thereof. As a result, use of the mailing assembly 100 of the present invention substantially simplifies and expedites the preparation of such a mailpiece requiring delivery by a special service, such as certified mail, return receipt for merchandise, insured mail, registered mail, and the like.

The designator section 110 includes a first area 112 that is distinctly colored from a remainder of the area. For example, the color of the first area 112 may be green to designate the generally recognized color for certified mail or may be brown to designate the generally recognized color for return receipt for merchandise, or the like. Within the first area 112, wording areas 114,116 may be provided to specifically denote the type of special service for which the mailing assembly is to be implemented. An article identifying number area 118 is provided within the designator section 110 to provide, preferably, a machine readable article identification number 119 associated with the mailpiece. This is particularly useful for tracking of the mailpiece before, during and after delivery by the special service. A machine readable article identification number 129 is also provided in the machine readable document control area 132 of the return postcard 108. The article identification number 119 is the same number as the article identification number 129. The bar code within the machine readable document control area 132 corresponds to the article identification number 129.

A special instruction area 120 is also incorporated within the designator section 110. Both the article identifying number area 118 and the special instruction area 120 have a distinctly colored background to improve the machine readability of the information within these areas. The special instruction area 120 may include, for example, specific instructions such as "RESTRICTED DELIVERY", "ADDRESSEE'S ADDRESS REQUESTED", "RETURN RECEIPT REQUESTED" or the like. The return postcard 108 includes other information generally required within specific sections, such as sender information area 122, article addressee area 124, recipient name area 126, recipient signature area 128, date received area 130, machine readable document control area 132, and addressee address area 134.

On each side of the return postcard 128 are anchor portions 136,138. The anchor portions 136,138 are separable from the return postcard 128 by perforated tear lines 140, 142, respectively. The anchor portions 136,138 may also be printed with variable information or pre-printed information relating to the mail handling or information of a general nature. As shown in the anchor portion 136, an article identifying number area 144 is provided that may include a machine readable article identifying number related to the special delivery of the mailpiece for which the mailing assembly is used. The article identifying number area 144 may be implemented as a removable label from within the anchor portion 136 separable therefrom by die-cut lines, score lines, or the like. The anchor portions 136,138 are removably secured to the second layer 104 via the adhesive 106.

As further illustrated, an auxiliary label 146 may be provided and implemented in a number of fashions. For example, the auxiliary label 146 may act as a mailing label, a return address label, or the like. The auxiliary label 146 may be separable from a remainder of the mailing assembly 100 via a score line 148. Alternatively, the score line 148 may be implemented as a perforated tear line, die-cut lines or the like. As a result, the auxiliary label 146 is separable from the remainder of the mailing assembly 100 as well as from the second layer 104 with an adhesive back side for attachment to, for example, a mailpiece.

As illustrated in FIG. 9, the mailing assembly 100 is attached to a mailpiece 150 by removing the mail assembly 100 from the second layer 104 and attachment of the anchor portions 136,138 using the adhesive 106 on a back side of the anchor portions 136,138 for attachment to the mailpiece 150. The return postcard 108 is separable from the anchor portions 136,138 following delivery of the mailpiece 150 to, for example, confirm receipt of delivery of the mailpiece 150. As illustrated, the auxiliary label 146 is incorporated as a return address label. Alternatively, the auxiliary label 146 may be used as an addressee's label and incorporated in the area generally designated at 152 in FIG. 9.

Figure 10:
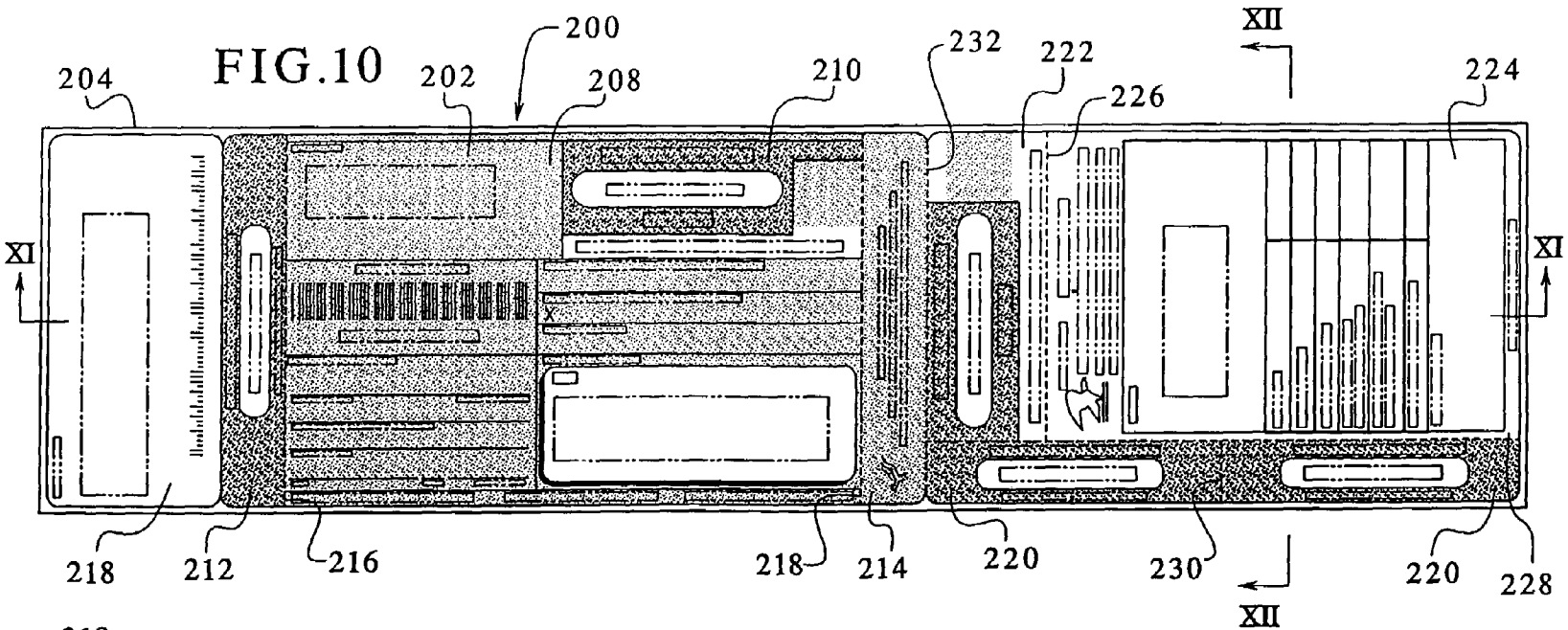
FIG. 10 illustrates a plan view of a front side of yet another embodiment of an assembly of the present invention.
Figure 11:
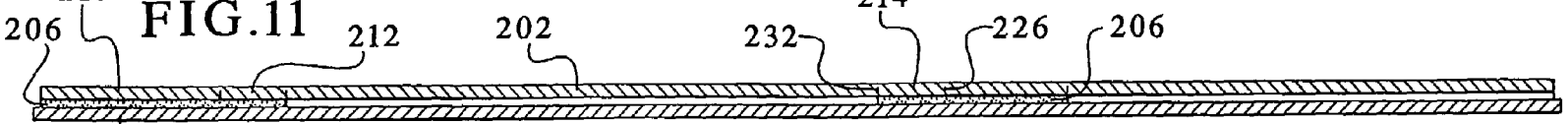
FIG. 11 illustrates a cross-sectional view taken generally along the line XI-XI of FIG. 10.
Figure 12:
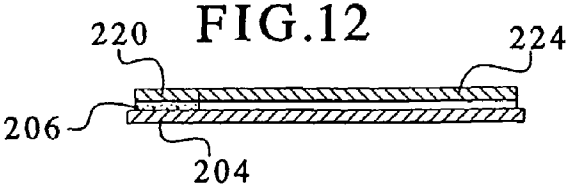
FIG. 12 illustrates a cross-sectional view taken generally along the line XII-XII of FIG. 10.

Referring now to FIGS. 10-12, an alternate embodiment of a mailing assembly 200 is generally illustrated. The assembly 200 incorporates a first layer 202 and a second layer 204 with an adhesive 206 in selected areas therebetween as generally illustrated in FIGS. 11 and 12. The first layer 202 of the mailing assembly 200 includes a return postcard 208 with an incorporated designator section 210. At each end of the return postcard 208 are anchor portions 212,214 separable by perforated tear lines 216, 217, respectively. On a back side of each of the anchor portions 212,214 is the adhesive 206. The adhesive 206 provides for attachment of the first layer 202 to the second layer 204 and following removal of the first layer 202 from the second layer 204, the adhesive 206 beneath the anchor portions 212,214 allows for attachment of the first layer 202 to a mailpiece. An auxiliary label 218 is provided exterior to the anchor portion 212 and has the adhesive 206 on its back side. As a result, the auxiliary label 218 may be implemented as described with references to FIGS. 7-9.

The mailing assembly 200 also includes additional article identifying number areas 220 with the adhesive 206 on its back side for removable attachment from the second layer 204 and subsequent attachment of the article identifying number area 220 to a specific item as necessary. In addition, the mailing assembly 220 may further include an additional designator section 222 that substantially repeats the information in the designator section 210 for additional usage on the mailpiece on which the mailing assembly 200 is implemented.

Further, the mailing assembly 200 may include a receipt section 224. The receipt section 224 is a receipt for the sender of the mailpiece. The receipt section 224 generally includes information corresponding to, for example, United States Postal Service Form 3800. The receipt 224 is detachable from a remainder of a mailing assembly 200 via perforated tear lines 226,228. The perforated tear line 228 is also implemented to remove the article identifying number areas 220 from a remainder of the mailing assembly 200 and is separately detachable one from the other via the perforated tear line 230. In addition, the auxiliary designator section 222 may also be separable from a remainder of the assembly 200, namely the anchor portion 214, via the perforated tear line 232. The embodiment illustrated in FIG. 10 may be implemented similarly to the invention shown and described with reference to FIGS. 7-9. The return receipt 224 is typically removed for use by the sender as verification that the special service was requested and the amount paid for that special service.

Either of the mailing assemblies 100,200 may be incorporated in a series of forms continuously repeated. Therefore, the mailing assemblies 100 or 200 may be linked together such that they are incorporated as a continuous series of forms or, alternatively, a roll of forms, or the like.

The second layer 104 or 204 of the mailing assemblies 100 or 200, respectively, may include an area that is die-cut with a frozen label such that if duplex printing is implemented and variable information is simultaneously or subsequently printed on a back side of the return postcard, for example, then that information remains on the back side of the return postcard following removal of the second layer from a remainder of the mailing assembly 100,200.

Figure 13:
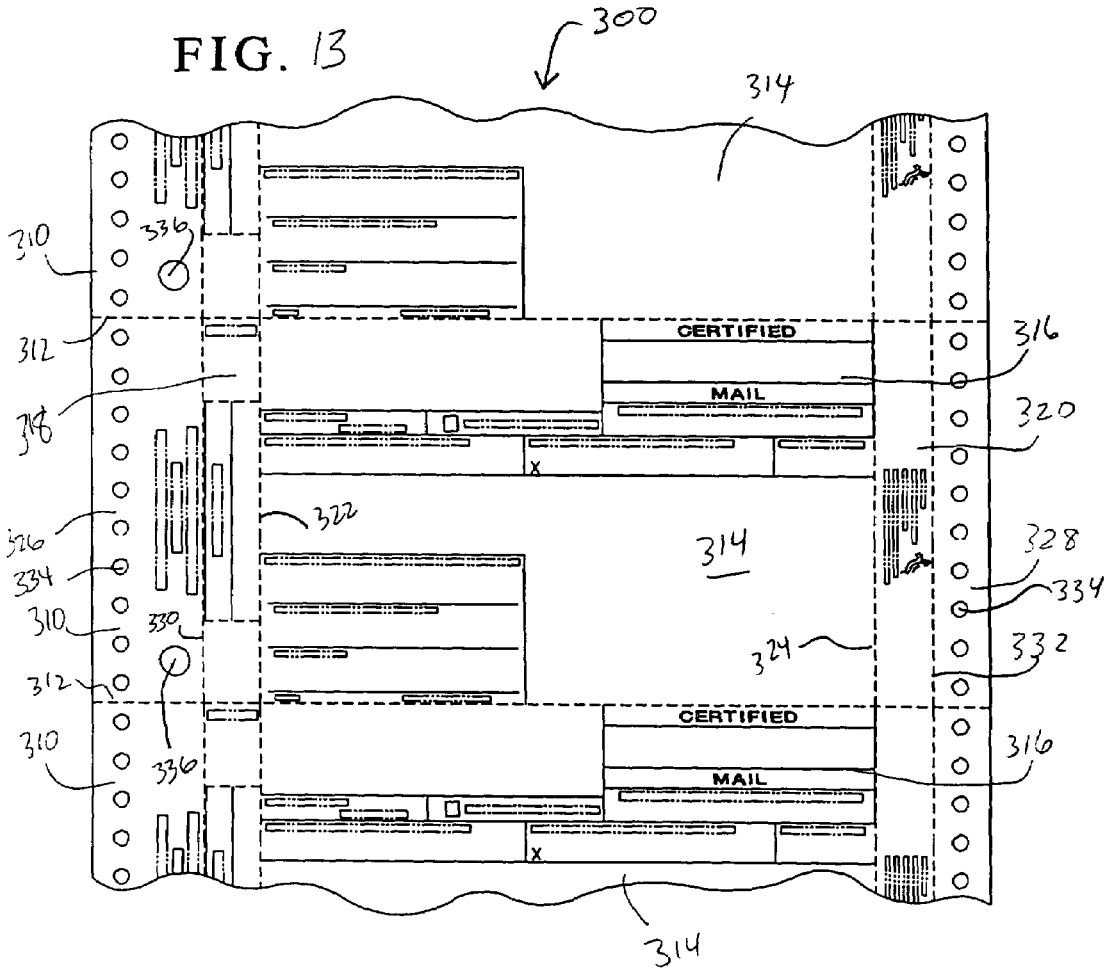
FIG. 13 illustrates a plan view of a front side of another embodiment of an assembly of the present invention.

Referring now to FIG. 13, an alternate embodiment of a mailing assembly 300 is generally illustrated. The mailing assembly 300 may include a plurality of mailing labels 310 continuously attached via tear lines 312. Each mailing label 310 may include a return postcard 314 with an incorporated designator section 316. The designator section 316 may correspond to a special service required for delivery of a mailpiece. The special services may include certified mail, registered mail, insured mail, return receipt for merchandise mail or the like. At each end of the return postcard 314 may be anchor portions 318,320 disposed on opposites sides of the return postcard 314. The anchor portions 318,320 may be separable from the return postcard 314 via tear lines 322 and 324, respectively.

Disposed adjacent to each of the anchor portions 318,320 may be printer track strips 326,328, respectively. The printer track strips 326,328 may be removably attached to anchor portions 318,320, respectively, via tear lines 330,332, respectively. Printer track strips 326,328 may include holes 334 that may engage a printing device, such as a dot-matrix printer, or any like printer requiring a tracking mechanism. Such printing devices are well known to those skilled in the art and include appropriate mechanisms to engage the holes 334 on each of the printer track strips 326,328.

Alternatively, printing of the labels 310 may be performed using a thermal printer. A hole 336 may be disposed on the printer track strip 326 in a location to be identified by a thermal printer. The hole 336 may trigger a sensor on the thermal printer indicating to the thermal printer that the mailing label 310 is, for example, in a position to be printed by the thermal printer.

Various indicia may be printed upon the label 310 by any known printing means. However, the indicia including the special services designator 316 may be printed using only a single color. For example, if the designator 316 refers to certified mail, the certified mail designator 316 may be printed green to indicate the generally recognized color indicative of certified mail. The remaining indicia and any shading to be printed upon the label 310 may also be green. This allows the indicia and the designator 316 to utilize only one color thereby simplifying the printing process requiring a single color print cartridge, ribbon or the like. As indicated previously, each label 310 may be continuously attached to one another. This may allow the labels to be dispensed in a roll or other like manner so as to be fed into a machine or printing device continuously. This may simplify the printing process by allowing a large number of labels to be printed continuously in a printing device.

Figure 14:
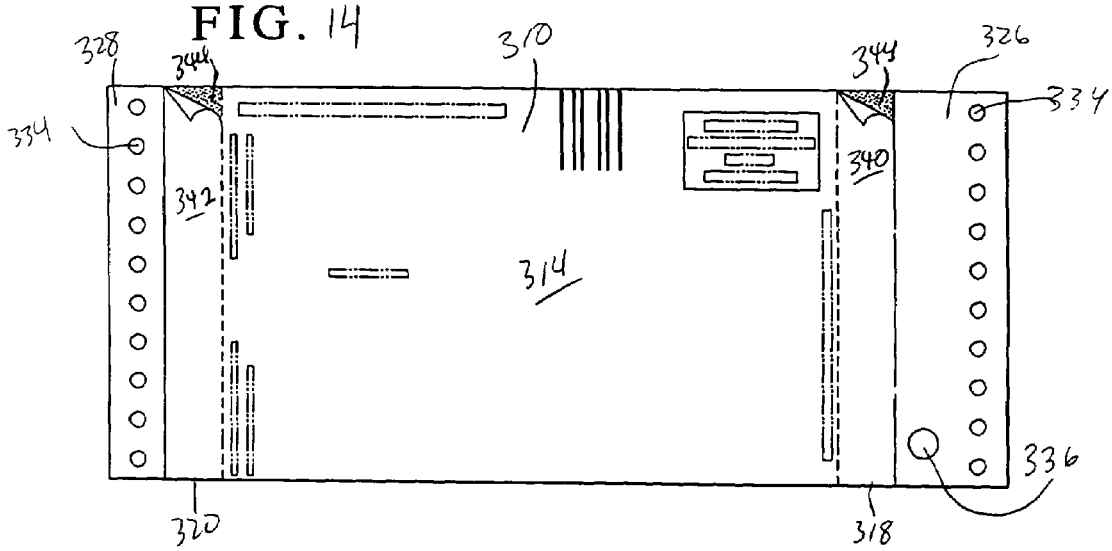
FIG. 14 illustrates a back side view of another embodiment of an assembly of the present invention.

Referring now to FIG. 14, a back side of the label 310 is generally shown. The label 310 may include the return postcard 314, the anchor portions 318,320, and the printer track strips 326,328. The printer track strips 326,328 may include the holes 334 and the thermal printing hole 336.

The anchor portions 318,320 may include backing strips 340,342, respectively. The backing strips 340,342 may be disposed over an adhesive layer 344 that is disposed over the backsides of the anchor portions 318,320.

Like the front side of the label 310, the back side may have indicia printed thereupon using the single color utilized for the front side of the label 310. Therefore, as previously indicated, only one print cartridge or ribbon or the like may be used to print the label 310.

In use, information may be printed upon the label 310 to aid in the delivery of a mailpiece by a special service indicated in the designator section 316. Printing may be done by any conventional printing means, especially including dot-matrix printing using printer tracking wheels having pins to engage the plurality of holes 334 on the labels 310. Alternatively, thermal printing may be used in which case the hole 336 on the printer track strip 326 may be sensed by the thermal printer. After completion of the printing, an individual label 310 may be removed from a remainder of the assembly 300 via the tear lines 312. The printer track strips 326,328 may be removed via tear lines 330, 332, respectively. The backing strips 340, 342 may be removed exposing the adhesive layer 344. The remainder of the label 310, including the return postcard 314 and the anchor portions 318,320, may be attached to a mailpiece for delivery by the special service indicated by the designator section 316.

Upon delivery of the mailpiece by the special service indicated in the designator section 316, the return postcard 314 may be removed from the anchor portions 318,320 via tear lines 322,324, respectively. The return postcard 314 may be returned to the sender of the mailpiece indicating to the sender of the mailpiece that delivery was effected.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A special service mailing assembly comprising:

a plurality of labels separably attached wherein each one of the plurality of labels has a front side and a back side wherein the front side and the back side are planar and face in opposing directions and further wherein each one of the plurality of labels has a return postcard and a designator section indicative of one of a plurality of special services wherein the special service is one of a certified mailing, a return receipt for merchandise mailing, an insured mailing and a COD mailing wherein the designator section is contained completely within the exterior sides that define the return postcard and further wherein the designator section has shading of a first color and printing of the same color as the first color wherein the first color is indicative of the special service; and a printer track strip associated with each one of the plurality of labels wherein the printer track strip has a first hole and further wherein each one of the plurality of labels has a second hole.

2. The assembly of claim 1 further comprising:

a first anchor portion removably associated with each label removably attached to each return postcard wherein the first anchor portion has an adhesive on a backside of the first anchor portion.

3. The assembly of claim 1 wherein the second hole on each label is capable of being sensed by a printer.

4. The assembly of claim 1 further comprising:

an area within each designator section printed with an article identification number.

5. The assembly of claim 1 further comprising:

a second anchor portion associated with each label wherein the second anchor portion has an adhesive on a backside of the anchor portion.

6. The assembly of claim 1 further comprising:

a tear line disposed between each label to aid in the removal of each label from the assembly.

7. The assembly of claim 1 further wherein the second hole is adjacent to the tracking strip.

8. The assembly of claim 2 further comprising:

a strip disposed over the adhesive on the backside of the first anchor portion.

9. A special service mailing assembly comprising:

a label having a front side and a back side wherein the front side and the back side are planar and face in opposing directions wherein the label has a return postcard and a designator section indicative of one of a plurality of special services wherein the special service is one of a certified mailing, a return receipt for merchandise mailing, an insured mailing and a COD mailing wherein the designator section is contained completely within exterior sides that define the return postcard and further wherein the designator section has shading of a first color and printing of the same color as the first color wherein the first color is indicative of the special service and further wherein the label has a hole disposed therein.

10. A special service mailing assembly comprising:

a label having a front side and a back side wherein the front side and the back side are planar and face in opposing directions wherein the label has a return postcard and a designator section indicative of one of a plurality of special services wherein the special service is one of a certified mailing, a return receipt for merchandise mailing, an insured mailing and a COD mailing wherein the designator section is contained completely within exterior sides that define the return postcard and further wherein the designator section has shading of a first color and printing of the same color as the first color wherein the first color is indicative of the special service and further wherein the label has a width defined between a first end and a second end wherein the first end has holes disposed therein.

11. A method for preparing a mailpiece for delivery by a special service, the method comprising the steps of:

providing a label having a front side and a back side wherein the front side and the back side are planar and face in opposing directions wherein the label has a return postcard and a designator section indicative of one of a plurality of special services wherein the special service is one of a certified mailing, a return receipt for merchandise mailing, an insured mailing and a COD mailing wherein the designator section is contained completely within exterior sides that define the return postcard and further wherein the designator section has shading of a first color and printing of the same color as the first color wherein the first color is indicative of the special service wherein the first color is one of green indicative of certified mailing or brown indicative of return receipt for merchandise mailing;

providing at least one anchor portion on an exterior side of the return postcard wherein the anchor portion has a backside and further wherein the backside of the anchor portion includes an adhesive;

removing a backing strip disposed over the adhesive;

attaching the label to a mailpiece to effect delivery by the special service; and providing a hole in the label.

12. A special service mailing assembly comprising:

a label having a first layer and a second layer opposite to the first layer wherein the first layer is separably attached to the second layer with an adhesive wherein the label has a return postcard and a designator section indicative of one of a plurality of special services wherein the special service is one of a certified mailing, a return receipt for merchandise mailing, an insured mailing and a COD mailing wherein the designator section is contained completely within exterior sides that define the return postcard wherein the designator section and the return postcard are printed with an article identification number wherein the article identification number in the designator section and the article identification number in the return postcard are the same number and further wherein the designator section has shading of a first color and printing of the same color as the first color wherein the first color is indicative of the special service wherein the first color is one of green indicative of certified mailing or brown indicative of return receipt for merchandise mailing.

13. The assembly of claim 12 further comprising:

a first anchor portion associated with the label removably attached to the return postcard wherein the first anchor portion has an adhesive on a backside of the first anchor portion.

14. The assembly of claim 12 further comprising:

an area within the designator section that has a machine readable code.

15. The assembly of claim 12 further comprising:

a second anchor portion attached to the return postcard wherein the second anchor portion has an adhesive on a backside of the anchor portion.

16. The assembly of claim 13 further comprising:

a backing strip disposed over the adhesive on the backside of the first anchor portion.

17. A method for preparing a mailpiece for delivery by one of a plurality of special services wherein the special services are any one of a certified mailing, a return receipt for merchandise mailing, an insured mailing and a COD mailing, the method comprising the steps of:

providing a label having a front side and a backside opposite to the front side wherein the label has a return postcard integrally formed with a designator section indicative of one of the plurality of special services wherein the return postcard is a single layer wherein the designator section is contained completely within exterior sides that define the return postcard wherein the designator section has shading of a first color and printing of the same color as the first color wherein the first color of the shading or the printing is indicative of one of the plurality of special services wherein the first color is one of green indicative of certified mailing or brown indicative of return receipt for merchandise mailing;

providing at least one anchor portion indicative of one of the plurality of special services on an exterior side of the return postcard wherein the anchor portion has a backside and further wherein the backside of the anchor portion includes an adhesive;

removing a backing strip disposed over the adhesive; and attaching the label to a mailpiece to effect delivery by one of the plurality of special services.

* * * * *